US007866080B2

(12) United States Patent
Tucker

(10) Patent No.: US 7,866,080 B2
(45) Date of Patent: Jan. 11, 2011

(54) SPEED LOADER FOR A GUN, AND RELATED SYSTEMS AND METHODS

(76) Inventor: John Tucker, 24111- 23rd Ave. W., Bothell, WA (US) 98021

( * ) Notice: Subject to any disclaimer, the term of this patent is extended or adjusted under 35 U.S.C. 154(b) by 695 days.

(21) Appl. No.: 11/890,992

(22) Filed: Aug. 7, 2007

(65) Prior Publication Data

US 2010/0313460 A1 Dec. 16, 2010

Related U.S. Application Data

(60) Provisional application No. 60/836,505, filed on Aug. 8, 2006.

(51) Int. Cl.
*F41A 9/82* (2006.01)

(52) U.S. Cl. ..... 42/87; 42/88; 42/90

(58) Field of Classification Search ..... 42/87, 42/88, 90

See application file for complete search history.

(56) References Cited

U.S. PATENT DOCUMENTS

| | | | | | |
|---|---|---|---|---|---|
| 356,276 | A | | 1/1887 | Diss | |
| 402,605 | A | | 5/1889 | Mauser | |
| 782,556 | A | * | 2/1905 | Goss | 42/88 |
| 869,632 | A | | 10/1907 | Hockett | |
| 1,874,408 | A | * | 8/1932 | Zichy | 42/87 |
| 2,856,720 | A | * | 10/1958 | Kunz | 42/87 |
| 2,981,024 | A | | 4/1961 | Skoff | |
| 3,242,609 | A | | 3/1966 | Koistinen | |
| 3,342,609 | A | * | 9/1967 | Bank et al. | 426/110 |
| 3,916,552 | A | * | 11/1975 | Pichard et al. | 42/87 |
| 4,509,284 | A | * | 4/1985 | Naber | 42/87 |
| 4,720,931 | A | * | 1/1988 | Jensen | 42/87 |
| 4,756,110 | A | * | 7/1988 | Beltron | 42/87 |
| 4,862,621 | A | | 9/1989 | Kearney | |
| 4,862,821 | A | * | 9/1989 | Ballantyne | 114/293 |
| 4,869,009 | A | * | 9/1989 | Bennett | 42/87 |
| 6,185,853 | B1 | * | 2/2001 | Sniezak et al. | 42/87 |
| 2009/0044440 | A1 | * | 2/2009 | Tal et al. | 42/87 |

* cited by examiner

*Primary Examiner*—J. W Eldred
*Assistant Examiner*—Gabriel J Klein
(74) *Attorney, Agent, or Firm*—Janeway Patent Law PLLC; John Janeway

(57) ABSTRACT

A loader for inserting an ammunition cartridge into a gun's magazine includes a body operable to hold two or more ammunition cartridges, a retainer to prevent a cartridge held by the body from leaving the body and operable to release a held cartridge from the body to position the cartridge for insertion into a gun's magazine, and an insertion component to exert pressure on a positioned cartridge to insert the cartridge into the gun's magazine. When the loader is used to insert a cartridge into a gun's magazine, the insertion component extends into the gun's carrier opening, a cartridge from the body is positioned on the insertion component, and the body is then moved relative to the gun's magazine. By holding the cartridges with the body and forcing a positioned cartridge into the gun's magazine with the insertion component, one can quickly and efficiently load a gun's magazine.

9 Claims, 2 Drawing Sheets

SPEED LOADER FOR A GUN, AND RELATED SYSTEMS AND METHODS

CROSS-REFERENCE TO RELATED APPLICATIONS

This application claims priority from commonly owned U.S. Provisional Patent Application 60/836,505, filed 8 Aug. 2006, and titled SHOTGUN SPEED LOADER, presently pending, which is incorporated herein by reference in its entirety and for all its teachings and disclosures.

BACKGROUND

Military and law enforcement personnel as well as competitive shooters desire a loader that is convenient, compact, and quickly reloads a gun's magazine. There are many loaders that one can use to reload a gun. Many of these loaders hold ammunition cartridges and facilitate dispensing the cartridges into a gun's magazine. For example, there are many tube-type loaders that include a pusher for pushing the held cartridges into a rifle or shotgun's magazine tube. In addition, shotgun magazines can be reloaded using a box loader that includes a lever and an ejector. But unfortunately, most of these loaders are bulky and inconvenient to carry. Therefore, there is a need for a simple and convenient loader for reloading a gun's magazine.

SUMMARY

In one aspect of the invention a loader for inserting an ammunition cartridge into a gun's magazine comprises a body operable to hold two or more ammunition cartridges. The loader also comprises a retainer to prevent a cartridge held by the body from leaving the body, and that is operable to release a held cartridge from the body to position the cartridge for insertion into a gun's magazine. In addition, the loader comprises an insertion component to exert pressure on a positioned cartridge to insert the cartridge into the gun's magazine. When the loader is used to insert a cartridge into a gun's magazine, the insertion component extends into the gun's carrier opening, a cartridge from the body is positioned on the insertion component, and the body is then moved relative to the gun's magazine. By holding the cartridges with the body and forcing a positioned cartridge into the gun's magazine with the insertion component, one can quickly and efficiently load a gun's magazine.

DETAILED DESCRIPTION

Various modifications to the disclosed embodiments will be readily apparent and the generic principles herein may be applied to other embodiments and applications without departing from the spirit and scope of the present discussion. Thus, the present discussion is not intended to be limited to the embodiments shown, but is to be accorded the widest scope consistent with the principles and features disclosed herein.

Figure 1:
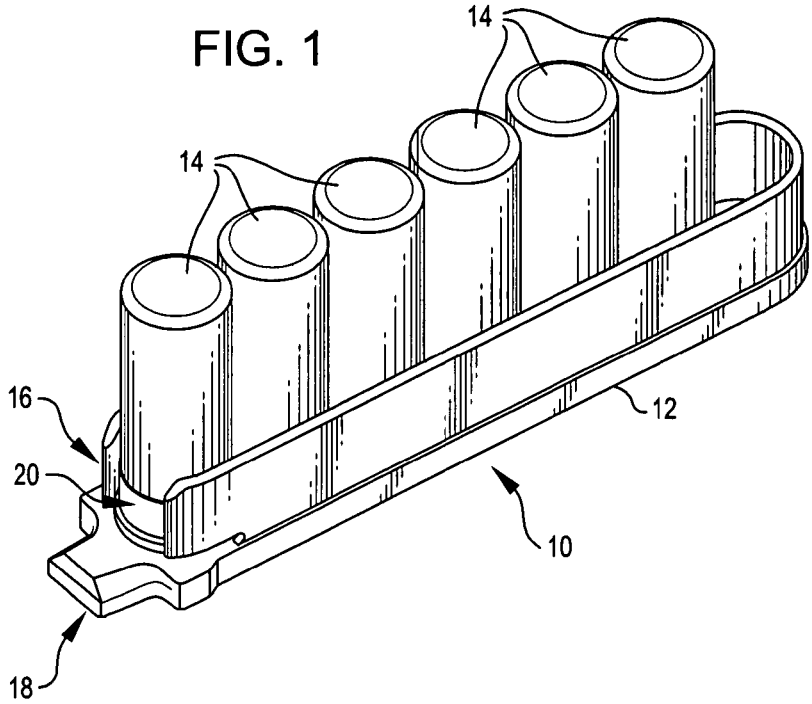
FIG. 1 is a perspective view of a loader holding ammunition cartridges, according to an embodiment of the invention.

FIG. 1 is a perspective view of a loader 10 according to an embodiment of the invention. The loader 10 includes a body 12 to hold two or more ammunition cartridges 14 (six shown here), which are shown as cartridges for a shotgun but could be cartridges for any type of gun and any gun caliber. The loader 10 also includes a retainer 16 to prevent the cartridges 14 from leaving the body 12, and an insertion component 18 to insert the cartridges 14 into a gun's magazine (discussed in greater detail in conjunction with FIG. 2). When the loader 10 is used to insert a cartridge 14 into a gun's magazine, the insertion component 18 is inserted into the gun's receiver (see FIG. 2), and the cartridge 14 immediately adjacent the retainer 16 is forced through the passage 20 and onto the insertion component 18. Thus, the retainer 16 is operable to release the cartridge 14 from the body 12. After the cartridge 14 is positioned on the insertion component 18, the insertion component 18 forces the cartridge 14 into the gun's magazine.

By holding the cartridges 14 with the body 12 and forcing a positioned cartridge 14 into the gun's magazine with the insertion component 18, one can quickly and efficiently load a gun's magazine.

Figure 2:
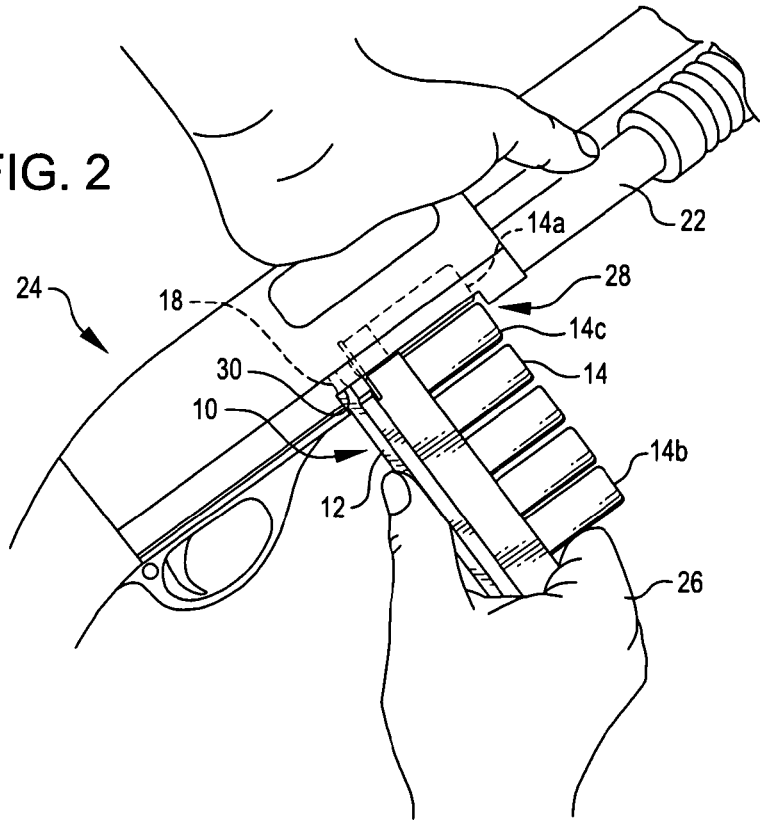
FIG. 2 is a perspective view of the loader in FIG. 1 being used to insert the ammunition cartridges in FIG. 1 into a gun's magazine, according to an embodiment of the invention.

FIG. 2 is a perspective view of the loader 10 in FIG. 1 being used to insert one of the cartridges 14 into the magazine 22 of a gun 24 (here a shotgun), according to an embodiment of the invention. In this and certain other embodiments of the method, the method includes moving the cartridges 14 to the insertion component 18 with one's hand 26, and moving the body 12 toward the magazine 22 to insert the cartridge 14*a* (shown in phantom) into the magazine 22.

For example, in this and certain other embodiments, one inserts the cartridges 14 into the magazine 22 by first grabbing the body 12 of the loader 10 and inserting the insertion component 18 into the gun's carrier opening 28. If the loader 10 includes the stop 30 (show here and discussed in greater detail in conjunction with FIG. 3), then one inserts the insertion component 18 until the stop 30 contacts the gun 24 and prevents the component 18 from being further inserted. If the loader 10 does not include a stop 30, then one inserts the insertion component 18 until one determines it has been inserted far enough, or until the insertion component 18 contacts an interior component of the gun 24. Then, with one's hand 26 one exerts pressure on the cartridge 14*b* to move the cartridge 14*a* through the passage 20 (FIG. 1) and into position on the insertion component 18. Then, one moves the body 12 toward the gun's magazine 22 to force the insertion component 18 against the cartridge 14*a* and cause the cartridge 14*a* to move into the magazine 22. Once the magazine 22 captures the cartridge 14*a*, one moves the body 12 away from the magazine 22 and inserts the next cartridge 14*c* into the magazine 22 following the same process described above.

Other embodiments of the cartridge insertion process are possible. For example, an additional component (not shown) of the loader 10 can be used to force a cartridge from the body 12 to the insertion component 18. This may be desirable if one prefers to not use or is not able to use one's hand to move the cartridges 14. In addition, another component (also not shown) of the loader 10 can be used to move the body 10 toward and away from the magazine 22. This may be desirable if one prefers to not use or is not able to use one's hand to move the body 12.

Figure 3:
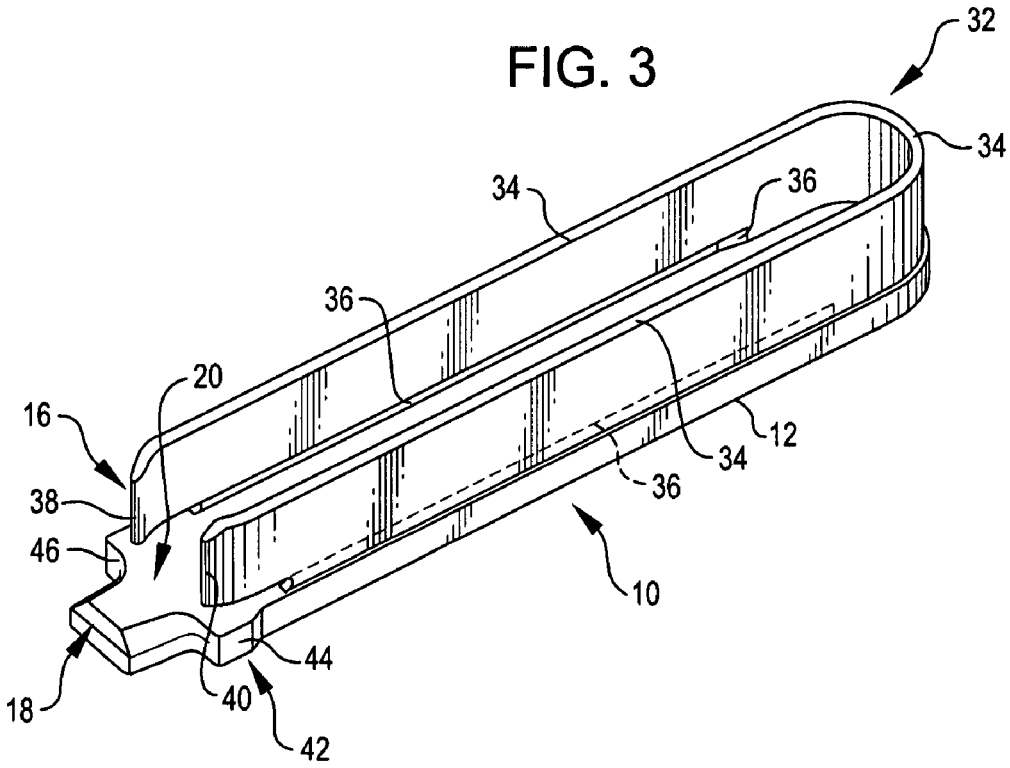
FIG. 3 is a perspective view of the loader in FIG. 1.

FIG. 3 is a perspective view of the loader 10 in FIG. 1 without the cartridges 14 (FIG. 1). In this and certain other embodiments of the loader 10, the body 12, the retainer 16, and the insertion component 18 are all integral with each other, that is they are all formed from a single piece of material. In other embodiments, however, one or more of these components can be permanently fixed or releasably attached to another of the loader's components in any manner desired.

Figure 4:
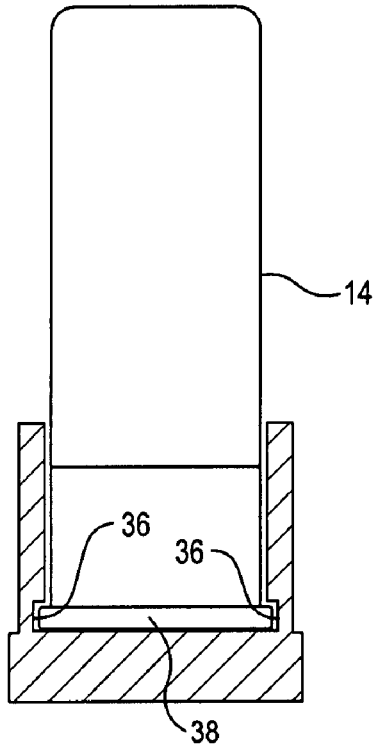
FIG. 4 is a cross-sectional view of the loader in FIG. 1.

In this and certain other embodiments of the loader 10, the body 12 is configured to hold cartridges 14 arranged as shown in FIG. 1, and includes a portion 32 that one can grip to insert a cartridge 14 into a gun's magazine 22 (FIG. 2) when the loader 10 holds its maximum number of cartridges 14. The body 12 can hold each cartridge 14 in any desired manner that allows the cartridges 14 to be positioned on the insertion component 18 before the cartridge 14 is inserted into a gun's magazine 22. For example, in this and certain other embodiments, the body 12 includes a skirt 34 and two grooves 36 (one shown in phantom) that can hold each cartridge 14. As shown in FIG. 4, both grooves 36 are sized to surround a portion of each cartridge's lip 38 when the cartridges 14 are held by the body 12, and to allow each cartridge 14 to slide toward the insertion component 18.

Other embodiments are possible. For example, the body 12 can be configured to the hold cartridges in a curved or spiral arrangement relative to each other. Furthermore, the body 12 can include any other desired holding component in addition to or replacement of the grooves 36, to hold the cartridges 14 and allow the cartridges 14 to be moved to the insertion component 18.

The retainer 16 can be configured as desired to prevent a cartridge 14 from leaving the body 12 and to release a cartridge 14 when acted upon. For example, in this and certain other embodiments of the loader 10, the retainer 16 includes a first cantilevered component 38 and a second cantilevered component 40 that are positioned to define a passage 20 that is narrower that the width of a cartridge 14, as measured from the first component 38 to the second component 40, to prevent an adjacent cartridge 14 from leaving the body 12 through the passage 20. To release the adjacent cartridge 14, the first and second cantilevered components 38 and 40 can bend elastically away from each other to widen the passage 20, and thus permit a cartridge 14 to slide to the insertion component 18. In addition, to facilitate loading the body 12 with cartridges 14, the first and second cantilevered components 38 and 40 are configured to bend elastically away from each other when a cartridge 14 that is on the insertion component 18 is forced toward the body 12.

Other embodiments are possible. For example, the retainer may be a strap anchored to the skirt 34 at one side of the passage 20 and releasably fastenable to the skirt 34 at the other side of the passage 20.

The insertion component 18 can be configured as desired to extend into a gun's carrier opening 28 (FIG. 2) and exert pressure on a cartridge 14 that has been positioned on it. For example, in this and certain other embodiments of the loader 10, the insertion component 18 is a plate that extends from the body 12 and that is stiff enough to transmit the force that one puts on the body 12 to a positioned cartridge 14 when moving the body 12 toward a gun's magazine 22. The distance that the insertion component 18 extends away from the body 12 can be any desired distance that is appropriate for a particular gun model or class of guns.

Still referring to FIG. 3, the loader 10 can include any desired component that prevents one from inserting the insertion component 18 beyond a predetermined distance. For example, in this and certain other embodiments of the loader 10, the loader includes a stop 42 that has a first stop component 44 and a second stop component 46. Together, the first and second stop components 42 and 44 contact a respective side of the gun's carrier opening 28 when the insertion component 18 has reached its maximum extension into the carrier opening 28.

From the foregoing, it will be appreciated that, although specific embodiments have been discussed herein for purposes of illustration, various modifications may be made without deviating from the spirit and scope of the discussion herein. Accordingly, the systems and methods include such modifications as well as all permutations and combinations of the subject matter set forth herein and are not limited except as by the appended claims.

What is claimed is:

1. A loader for inserting an ammunition cartridge into a magazine of a gun, the loader comprising:

a body operable to hold two or more ammunition cartridges, each cartridge having a longitudinal axis extending in the same direction as the respective cartridge's longest dimension and passing through the respective cartridge, wherein the body is operable to hold each cartridge in a position in which its longitudinal axis is parallel or substantially parallel with the longitudinal axis of another cartridge held by the body;

a retainer to prevent a cartridge held by the body from leaving the body, and that is operable to release a held cartridge from the body to position the cartridge for insertion into the magazine; and an insertion component to insert a positioned cartridge into the magazine, wherein when the insertion component inserts a cartridge into the magazine, the insertion component:

extends into a carrier opening of the gun, and pushes the positioned cartridge into the magazine as the body is moved relative to the magazine.

2. The loader of claim 1 wherein the body includes a groove configured to receive a portion of a rim of the cartridge to hold the cartridge.

3. The loader of claim 1 wherein the body includes two grooves configured to receive respective portions of a rim of the cartridge to hold the cartridge.

4. The loader of claim 1 wherein the body is operable to hold six cartridges.

5. The loader of claim 1 wherein:

the body includes a passage through which a cartridge can pass to leave the body, and the retainer includes a cantilevered component that extends into the passage to prevent a cartridge from passing through passage, and that elastically deforms to release a held cartridge.

6. The loader of claim 1 wherein:

the body includes a passage through which a cartridge can pass to leave the body, and the retainer includes a first cantilevered component and a second cantilevered component, each extending into the passage and toward the other cantilevered component to prevent a cartridge from passing through passage, and each elastically deforming to release a held cartridge.

7. The loader of claim 1 wherein the body has an end that does not hold a cartridge and can be gripped to insert a cartridge into the magazine.

8. The loader of claim 1 further comprising a stop configured to prevent the extension of the insertion component into the carrier opening beyond a predetermined distance.

9. A system for loading a magazine of a gun, the system comprising:

two or more ammunition cartridges, each cartridge having a longitudinal axis extending in the same direction as the respective cartridge's longest dimension and passing through the respective cartridge; and a loader for inserting the cartridges into the magazine, the loader comprising:

a body holding the ammunition cartridges in a position in which the longitudinal axis of each cartridge is parallel or substantially parallel with the longitudinal axis of another cartridge, a retainer that prevents the cartridges from leaving the body, and that is operable to release each cartridge to position each cartridge for insertion into the magazine; and an insertion component to insert a positioned cartridge into the magazine, wherein when the insertion component inserts a cartridge into the magazine, the insertion component:

extends into a carrier opening of the gun, and pushes the positioned cartridge into the magazine as the body is moved relative to the magazine.

* * * * *